US010170270B1

(12) United States Patent
Seltzman

(10) Patent No.: US 10,170,270 B1
(45) Date of Patent: Jan. 1, 2019

(54) ION SOURCE

(71) Applicant: WISCONSIN ALUMNI RESEARCH FOUNDATION, Madison, WI (US)

(72) Inventor: Andrew Seltzman, Madison, WI (US)

(73) Assignee: WISCONSIN ALUMNI RESEARCH FOUNDATION, Madison, WI (US)

( * ) Notice: Subject to any disclaimer, the term of this patent is extended or adjusted under 35 U.S.C. 154(b) by 0 days.

(21) Appl. No.: 15/669,732

(22) Filed: Aug. 4, 2017

(51) Int. Cl.
*H01J 27/02* (2006.01)
*H01J 27/26* (2006.01)

(52) U.S. Cl.
CPC ..... *H01J 27/022* (2013.01); *H01J 27/26* (2013.01)

(58) Field of Classification Search
USPC ..... 250/396 R, 396 ML, 423 R, 424, 492.1, 250/492.3; 315/111.01, 111.11, 111.21, 315/111.31, 111.41, 111.71, 111.81, 507
See application file for complete search history.

(56) References Cited

U.S. PATENT DOCUMENTS

| | | | | |
|---|---|---|---|---|
| 5,646,576 | A | 7/1997 | Aston | |
| 5,838,120 | A | 11/1998 | Semenkin et al. | |
| 5,973,447 | A | 10/1999 | Mahoney et al. | |
| 6,818,257 | B2 | 11/2004 | Amann et al. | |
| 6,870,164 | B1 | 3/2005 | Baldwin et al. | |
| 6,919,672 | B2 | 7/2005 | Madocks | |
| 7,023,128 | B2 | 4/2006 | Madocks | |
| 7,259,378 | B2 | 8/2007 | Madocks | |
| 7,312,579 | B2 | 12/2007 | Zhurin | |
| 7,622,721 | B2 | 11/2009 | Gutkin et al. | |
| 8,925,294 | B2 * | 1/2015 | Fresco | H02N 11/002 60/202 |
| 2003/0077402 | A1 | 4/2003 | Amann et al. | |
| 2003/0234369 | A1 * | 12/2003 | Glukhoy | H01J 27/18 250/423 R |

(Continued)

FOREIGN PATENT DOCUMENTS

WO 2011017314 A2 2/2011

OTHER PUBLICATIONS

"Anode Ray," Wikipedia, retrieved from https://en.wikipedia.org/w/index.php?title=Anode_ray&oldid=783445106, pp. 1-2, date accessed Jul. 7, 2017.

(Continued)

*Primary Examiner* — Bernard Souw
(74) *Attorney, Agent, or Firm* — Seager, Tufte & Wickhem LLP

(57) ABSTRACT

An ion source device for producing an ion beam may include a housing having an opening, a first electrode, and a second electrode. A portion of the first electrode and the second electrode may be located within the housing. The first electrode may have a first side facing the opening and may be configured to provide an electric field toward the opening. The second electrode may be configured to provide an electron presence between the first electrode and the opening at least at times when the first electrode is not providing the first electric field. The ion source device may include a magnet and may produce a magnetic field generally perpendicular to the electric field provided by the first electrode. The ion source device may provide an ion beam with low turn on delay, which may be on the order of one microsecond or less, and low turn on jitter.

20 Claims, 15 Drawing Sheets

(56) References Cited

U.S. PATENT DOCUMENTS

| | | | | |
|---|---|---|---|---|
| 2004/0085023 | A1* | 5/2004 | Chistyakov | C23C 14/3471 315/111.21 |
| 2010/0199632 | A1* | 8/2010 | Fresco | H02N 11/002 60/202 |
| 2016/0148775 | A1 | 5/2016 | Madocks | |

OTHER PUBLICATIONS

"Krytron," Wikipedia, retrieved from https://en.wikipedia.org/w/index.php?title=Krytron&oldid=800044078, pp. 1-5, date accessed Oct. 2, 2017.
Shabalin et al., "Industrial Ion Sources and Their Application for DLC Coating," Advanced Energy, pp. 1-4, date accessed 2017.
"Ion Beam Neutralization," Kaufman & Robinson, Inc., pp. 1-2, 2003.
"Linear Anode Layer Ion Sources," General Plasma Inc., retrieved from http://www.generalplasma.com/ion-sources.html, pp. 1-1, 2017.
"Ion Beam Sources," VECOR, retrieved from www.vecorus.com/EN/ion_sources.php, dated accessed 2017.
"Product Line: Gridless End-Hall eH Sources," Kaufman & Robinson, Inc., retrieved from http://ionsources.com/product-line/gridless-end-hall-eh-sources/, 2017.
"Ultra Compact Generator," Phoenix Nuclear Labs, LLC., retrieved from http://phoenixnuclearlabs.com/product/low-yield-neutron-generator/?gclid=CP2rudH9rtQCFQSqaQodxLYBQQ, 2015.
"Products: Neutronic Activities," Sodern Ariane Group, retrieved from http://www.sodern.com/website/en/ref/Neutronic_235.html, 2017.
"Neutron Generator ING-03," Del Mar Photonics, Inc., retrieved from http://www.dmphotonics.com/Neutron_Generators/neutron_generator_ING03_ING031.htm, date accessed 2017.
"Neutron Sources from Adelphi Technology can be used in industry, teaching and research. They are excellent tools for materials analysis,forensics, mining, healthcare and security," Adelphi Technology, Inc., retrieved from http://www.adelphitech.com/, 2016.
"Solar Electric Propulsion (SEP)," National Aeronautics and Space Administration, retrieved from https://www.nasa.gov/mission_pages/tdm/sep/index.html, date accessed 2017.
"Hollow Cathode," Wikimedia, retrieved from https://upload.wikimedia.org/wikipedia/en/6/6d/Fig221_Hollow_Cathode.PNG, date accessed 2017.
General Plasma, Inc. (2008). Classic Gridless Ion Beam Sources. [Brochure]. USA.
General Plasma, Inc. Pointed Pole Anode Layer Ion Source. [Brochure]. Tucson, AZ, date accessed 2017.

* cited by examiner

ION SOURCE

TECHNICAL FIELD

The present disclosure pertains to systems and methods for producing ion beams, and the like. More particularly, the present disclosure pertains to ion sources and related techniques for producing ion beams and reducing turn on delay and/or turn on jitter of the ion sources.

BACKGROUND

A variety of approaches and systems have been developed for producing ion beams. Such approaches and systems may include an electrode that produces an electric field in response to receiving a voltage, where the electric field may interact with gas around the electrode to produce an ion beam. The developed approaches and systems for producing an ion beam may require a delay after initially receiving a voltage before the ion beam is produced due to a need for the electric field to initiate breakdown of the gas (e.g., a gas with neutral gas atoms) into charged ions. Of the known approaches and systems for producing an ion beam, each has certain advantages and disadvantages.

SUMMARY

This disclosure is directed to several alternative designs for, devices of, and methods of using ion sources to produce ion beams. Although it is noted that approaches and systems for producing ion beams are known, there exists a need for improvement on those approaches and systems.

Accordingly, one illustrative instance of the disclosure may include an ion source for producing an ion beam. The ion source may include a housing having an opening and a first electrode within the housing. The first electrode may have a first side facing the opening of the housing and may provide an electric field toward the opening. The ion source may include a second electrode having an end within the housing. The second electrode may be configured to maintain a presence of electrons and/or seed plasma between the first electrode and the opening when the electric field is absent.

Another illustrative instance of the disclosure may include an ion source having a first magnetic pole, a second magnetic pole, a first electric field generator, and a second electric field generator. The first magnetic pole and the second magnetic pole may, at least partially, define an opening. The first electric field generator may be configured to provide a first electric field toward the opening and the second electric field generator may be configured to provide a second electric field between the first electric field generator and the opening.

Another illustrative instance of the disclosure may include a method of providing an ion beam. The method may include emitting electrons between an anode and an opening of a housing to provide a presence of electrons and/or seed plasma adjacent the anode, applying a power to the anode to generate an electric field while the presence of electrons and/or seed plasma adjacent the anode is provided, and discharging an electric discharge through the opening in the housing to produce an ion beam.

The above summary of some example embodiments is not intended to describe each disclosed embodiment or every implementation of the disclosure.

BRIEF DESCRIPTION OF THE DRAWINGS

The disclosure may be more completely understood in consideration of the following detailed description of various embodiments in connection with the accompanying drawings, in which.

Figure 1:
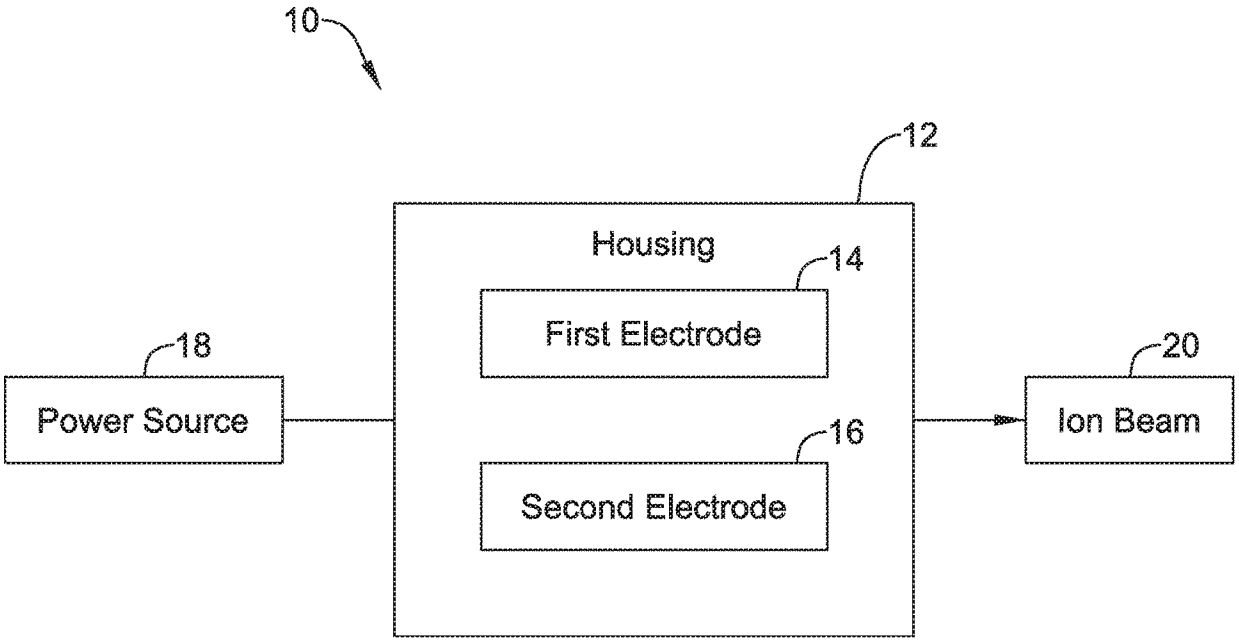
FIG. 1 is a schematic box diagram of an illustrative ion source.

While the disclosure is amenable to various modifications and alternative forms, specifics thereof have been shown by way of example in the drawings and will be described in detail. It should be understood, however, that the intention is not to limit aspects of the claimed disclosure to the particular embodiments described. On the contrary, the intention is to cover all modifications, equivalents, and alternatives falling within the spirit and scope of the claimed disclosure.

DESCRIPTION

For the following defined terms, these definitions shall be applied, unless a different definition is given in the claims or elsewhere in this specification.

All numeric values are herein assumed to be modified by the term "about", whether or not explicitly indicated. The term "about" generally refers to a range of numbers that one of skill in the art would consider equivalent to the recited value (i.e., having the same function or result). In many instances, the term "about" may be indicative as including numbers that are rounded to the nearest significant figure.

The recitation of numerical ranges by endpoints includes all numbers within that range (e.g., 1 to 5 includes 1, 1.5, 2, 2.75, 3, 3.80, 4, and 5).

Although some suitable dimensions, ranges and/or values pertaining to various components, features and/or specifications are disclosed, one of skill in the art, incited by the present disclosure, would understand desired dimensions, ranges and/or values may deviate from those expressly disclosed.

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

As used in this specification and the appended claims, terms such as first, second, third, and so on, along with top, bottom, side, left, right, above, below, and/or other similar relative terms and are used herein for descriptive purposes unless the content clearly dictates otherwise.

The following detailed description should be read with reference to the drawings in which similar elements in different drawings are numbered the same. The detailed description and the drawings, which are not necessarily to scale, depict illustrative embodiments and are not intended to limit the scope of the claimed disclosure. The illustrative embodiments depicted are intended only as exemplary. Selected features of any illustrative embodiment may be incorporated into an additional embodiment unless clearly stated to the contrary.

An ion source (e.g., an anode layer ion source, other Hall-current ion sources, and/or other types of ion sources), may produce ion beams. In some cases, the ion beam produced by an ion source may be an ion beam of plasma (e.g., a high temperature or other temperature ionized gas of positive ions and free electrons), which may be used for plasma processing, surface modification (e.g., smoothing, hardening, and/or other modifications of surfaces), film deposition, plasma thrusters, bomb detection, material analysis, and/or other industrial or research purpose.

An example ion source may include a magnetic system with an annular gap or opening between its poles and an electrode (e.g., an anode) housed within or adjacent to the gap or opening and connected to a positive terminal of a power supply. Free electrons may then drift above the electrode due to the electric field interacting with a magnetic field created in the gap between the poles of the magnetic system. As a result of collisions between the drifting electrons and neutral gas (e.g., ambient gas or gas from an active gaseous supply system), the atoms of the gas may become ionized. The charged gas ions and free electrons may then be accelerated due to the electric field created by the electrode.

The concepts disclosed herein are primarily described with respect to an anode layer ion source. Even so, the disclosed concepts may be used with other types of ion sources including, but not limited to, other types of Hall-current ion sources (extended channel Hall-current ion source, space-charge sheath Hall-current ion source, end-Hall Hall-current ion source, etc.)

The anode layer ion sources discussed herein may utilize a grid-less design (e.g., with no ion accelerating grids in an ion beam path) and a closed electron drift surface. With the closed electron drift surface, magnetic fields and electric fields of the anode layer ion source may interact and cause electrons to orbit above an electrode (e.g., an anode) such that the electrons collide with gas atoms to ionize the gas. Other anode layer ion sources may include an accelerating grid in an ion beam path produced by the ion source and/or may not include a closed electron drift surface.

An anode layer ion source may be differentiated from other closed drift ion sources by a spacing of a gap between poles of the magnetic system and a gap between the poles and an electrode. In anode layer ion sources, the gap between the poles and the gap between the poles and the electrode may be on the order of 2-3 millimeters (mm) or other size such that an electron confinement region (e.g., a region within the gaps) is too small for a conductive plasma to be sustained. Because the electron confinement region is too small for a conductive plasma to generate, the anode layer ion source may be operated in a collimated, high voltage mode. In one example, the electrode of the anode layer ion source may receive 1000s of volts and the ions may be efficiently emitted from the anode layer ion source. If the gaps are larger, a conductive plasma may be sustained in gap between the poles, which may cause electric fields to shift around the plasma and result in having to operate the anode layer ion source in a diffuse mode.

In industry, anode layer ion sources may be run at continuous duty cycles rather than with a pulsed output. As such and because anode layer ion sources may not utilize radio frequency (RF) or filament based ionization to provide a source plasma independent from an accelerating electric field from the electrode of the ion source, ion beam initiation may be delayed after application of a voltage to the electrode until the voltage on the electrode initiates a breakdown of the gas (e.g., a neutral gas) around the electrode into a plasma (e.g., free electrons and ionized gas atoms). Because of this delay, pulse characteristics of an anode layer ion source or other ion source may include a turn on delay (e.g., an average time between commanded and an actual start time of an ion pulse) and a turn on jitter (e.g., a variability in actual turn on time). The turn on delay may limit a maximum pulse frequency and turn on jitter may limit a pulse width. Typical turn on delay from an initial application of voltage to an electrode of an ion source until an ion beam current is produced may be on the order of about two (2) milliseconds (ms).

It has been found that the turn on delay may be reduced and the turn on jitter may be lowered by providing a seed plasma (e.g., a seed amount or initial amount of ionized gas) and/or electrons adjacent an electrode of an ion source (e.g., adjacent an anode of an anode layer ion source or other electrode of an ion source). A seed plasma may be an amount of ionized gas applied to an ion source before applying a voltage to an electrode (e.g., an anode) that facilitates speeding up the commutation of a plasma discharge (e.g., ion beam discharge), but does not cause a plasma arc to occur between the electrode of the ion source and an element providing the seed plasma. Electrons may be provided adjacent the electrode through field emission and/or one or more other techniques to facilitate speeding up the commutation of a plasma discharge without causing a plasma arc to occur between the electrode of the ion source an element providing the electrons. In some cases, as discussed in greater detail below, the addition of a seed plasma and/or electrons between the electrode of an ion source and a gap between magnetic poles may facilitate an ion source that has a turn on delay on the order of approximately 1 microsecond or less and a low turn on jitter. Such a short turn on delay and low turn on jitter may facilitate fast ion pulse generation. Additionally, as electrons may remain present around the electrode (e.g., above or between the electrode and the gap between magnetic poles), subsequent ion pulses after an initial ion pulse may have lower delay. Further, high ion beam current output on the order of 100s of milliamperes (mA) may be achieved.

Turning to the Figures, FIG. 1 is a box diagram of an ion source 10 configured to have reduced or short turn on delay with low turn on jitter. As shown in FIG. 1, the ion source 10 may include a housing 12 with a first electrode 14 and a second electrode 16. The first electrode 14 and/or the second electrode 16 may be in communication with one or more power sources 18.

In an anode layer ion source, the first electrode 14 may be an anode configured to provide a main electric field when in communication with a positive terminal of a power source. In other ion sources, the first electrode may be a different type of electrode configured to provide a main electric field for producing an ion beam.

The second electrode 16 may be connected to either a positive terminal or a negative terminal of the power source 18. The second electrode 16, when connected to a positive terminal of the power source 18, may be configured to provide an electric field that interacts with gas atoms to supply a seed plasma between the first electrode 14 and an opening (not shown in FIG. 1) in the housing 12. The second electrode 16, when connected to a negative terminal of the power source 18, may be configured to emit electrons through field emission or provide an electric field that interacts with gas atoms to supply a seed plasma between the first electrode 14 and the opening in the housing 12. When the second electrode emits electrons through field emission or provides an electric field that interacts with gas atoms to produce a seed plasma may depend on a voltage applied to the second electrode 16 and a pressure of gas around the second electrode 16.

The second electrode 16 may be considered a "keep-alive" electrode and may include one or more electrodes or field emission devices connected to a power source. For example, although the second electrode 16 may be referred to herein in the singular, the second electrode 16 may include two or more electrodes that perform the function of a keep-alive electrode (e.g., to facilitate providing a seed plasma and/or electrons) to speed up the production of charged ions when a voltage is applied to the first electrode 14 without creating a plasma arc with the first electrode 14. When the second electrode 16 includes two or more electrodes, the two or more electrodes may be adjacent one another and/or spaced from one another.

In operation, the second electrode 16 may receive a current from the power source 18 or other power source and output an electric field that interacts with ambient gas or other gas (e.g., through field emission, Paschen breakdown, etc.) to produce a seed plasma. The seed plasma may be provided at a location between the first electrode 14 and an opening (not shown) of the housing 12. The first electrode 14 may receive a power from the power source 18 or other power source and output an electric field that interacts with the seed plasma and atoms of gas around the first electrode 14 to produce plasma and an ion beam 20.

Although FIG. 1 depicts the power source 18 as being separate from the ion source 10, the power source 18 or a portion of the power source 18 may be included in the ion source 10 (e.g., connected to and/or within the housing 12) and in communication with one or both of the first electrode 14 and the second electrode 16. Further, the power source 18 may be a single power source or two or more power sources. For example, a single power source may provide power to both of the first electrode 14 and the second electrode 16. Alternatively, one or more first power sources may provide power to the first electrode 14 and one or more second power sources may provide power to the second electrode 16.

The power source 18 may be a suitable type of power source and the ion source 10 may receive power from one or more types of power sources 18. Example types of power sources may include, but are not limited to, line power source, a battery, a capacitor, a generator, and/or one or more other types of power sources.

FIGS. 2-6 depict various views of an illustrative anode layer ion source 30 that may create a closed drift and with which a keep-alive electrode may be utilized to reduce turn on delay and/or turn on jitter. The anode layer ion source 30 may take on a suitable shape. As shown in FIGS. 2-6, the anode layer ion source 30 may have a generally circular annular shape. Alternatively, the anode layer ion source 30 may have an elongated annular shape or other shape.

Figure 2:
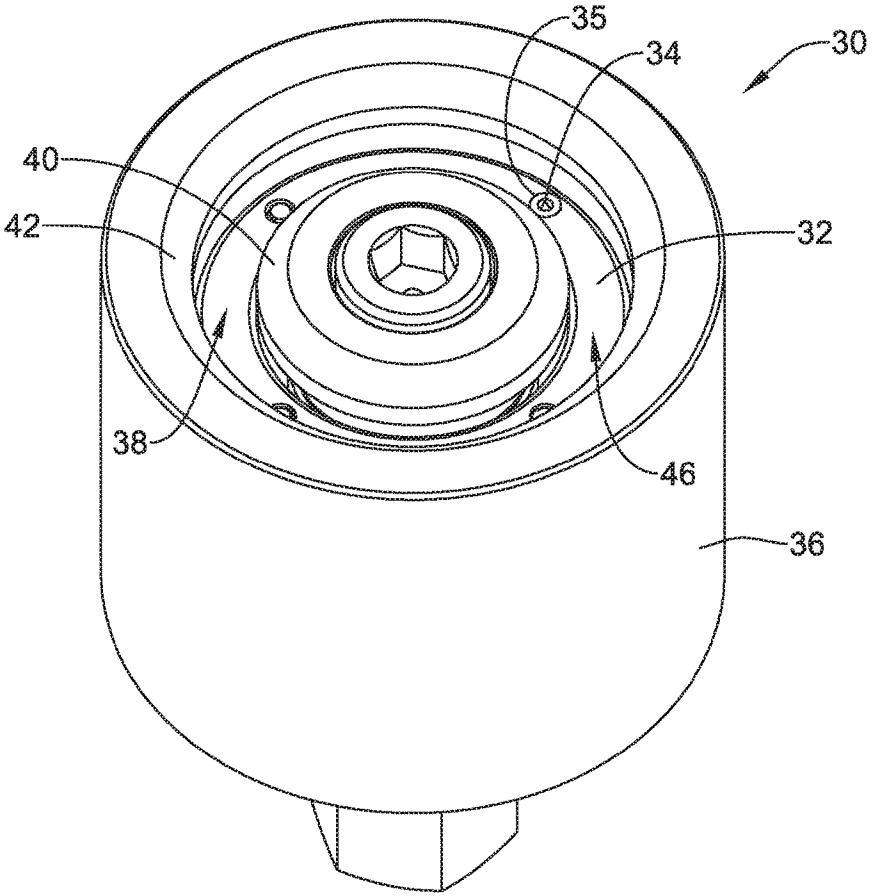
FIG. 2 is a perspective view of an illustrative anode layer ion source.

FIG. 2 is a perspective view of the anode layer ion source 30 incorporating an anode 32 (e.g., the first electrode 14) and a keep-alive electrode 34 (e.g., the second electrode 16) at least partially within a housing 36. Although not required, in some cases, an insulator 35 may extend along all or a portion of the keep-alive electrode 34. The housing 36 may include an opening 38 through which the anode layer ion source 30 may discharge an ion beam. Further, the anode layer ion source 30 may include a first pole 40 (e.g., a center pole) and a second pole 42 (e.g., an outer pole). The second pole 42 may be configured from the housing 36 and/or may include an element separate from the housing 36.

In some cases, the first pole 40 may be a first magnetic pole and the second pole 42 may be a second magnetic pole (e.g., where the first magnetic pole and/or the second magnetic pole may be coupled to a magnet, such as magnet 52 discussed below). A gap 46 may be located between the first pole 40 and the second pole 42 across which a magnetic field may be located.

The housing 36 and/or one or more of the first pole 40 and the second pole 42 may be made out of a suitable type of material. In one example, one or more of the housing 36, the first pole 40, and the second pole 42 may be made from a stainless steel (e.g., 410 stainless steel or other type of stainless steel) and/or other material.

Figure 3:
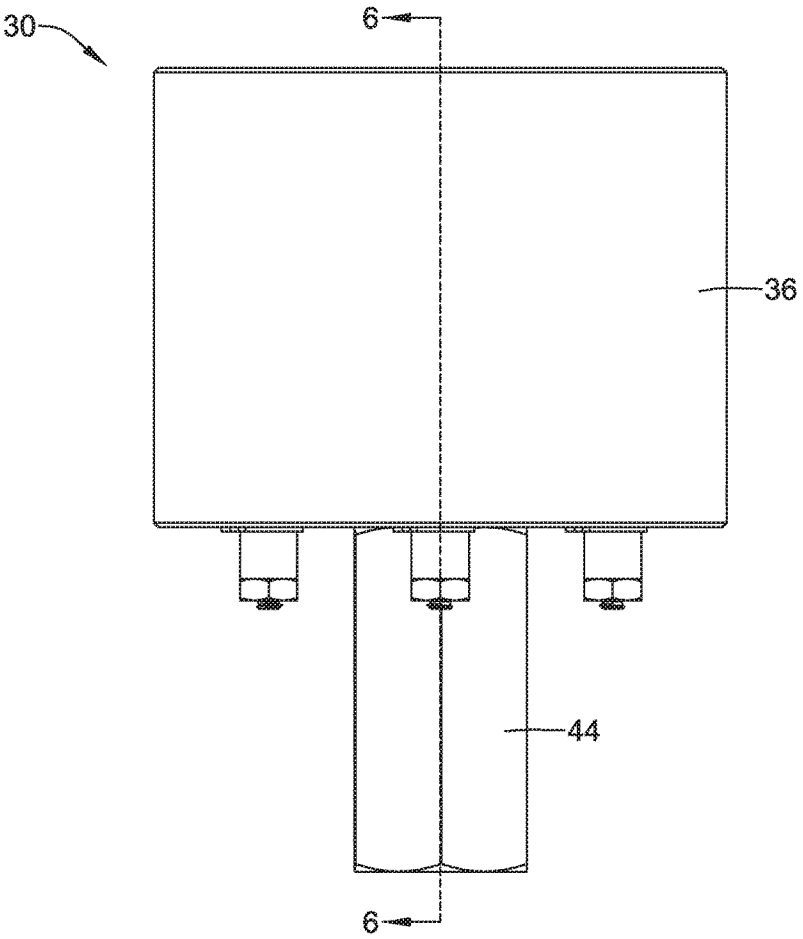
FIG. 3 is a side view of the illustrative anode layer ion source in FIG. 2.

FIG. 3 is a side view of the anode layer ion source 30. As depicted in FIG. 3, the anode layer ion source 30 may include the housing 36 and a standoff 44. The standoff 44 facilitate mounting the anode layer ion source to another device or system. In some cases, the standoff 44 may include internal (see FIG. 6) and/or external connecting features. For example, the standoff 44 may include one or more male or female connecting features including, but not limited to, threads, a bayonet connector, a ball-detent connector, and/or other connecting features.

Figure 4:
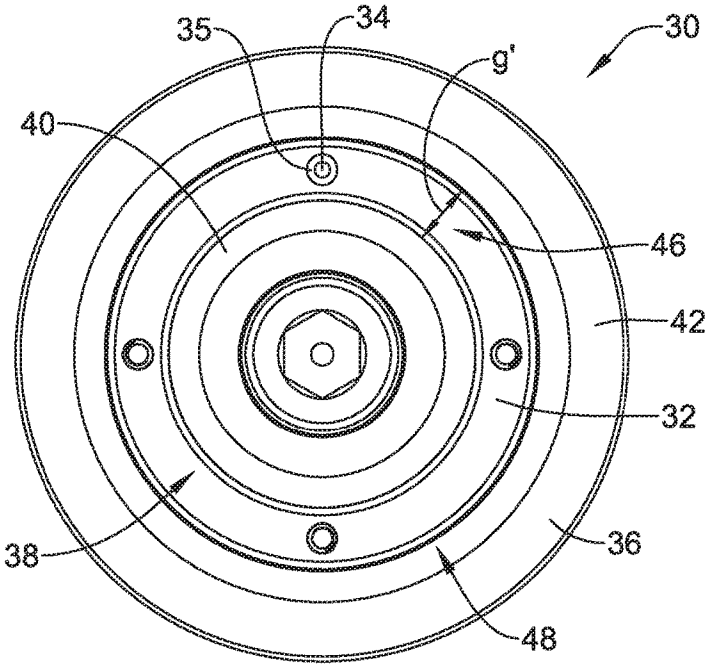
FIG. 4 is a first end view of the illustrative anode layer ion source in FIG. 2.

FIG. 4 is an end view of an opened end 48 of the anode layer ion source 30 depicting the anode 32 through the opening 38 of the housing 36. Line g' in FIG. 4 may represent a width of the gap 46 between the first pole 40 and the second pole 42. As is seen in FIG. 4, the anode 32 may be a ring shape, but this is not necessarily required. In some cases, the shape of the anode 32 may be related to a shape of the anode layer ion source 30, the gap 46 between the first pole 40 and the second pole 42, and/or one or more other factors.

Figure 5:
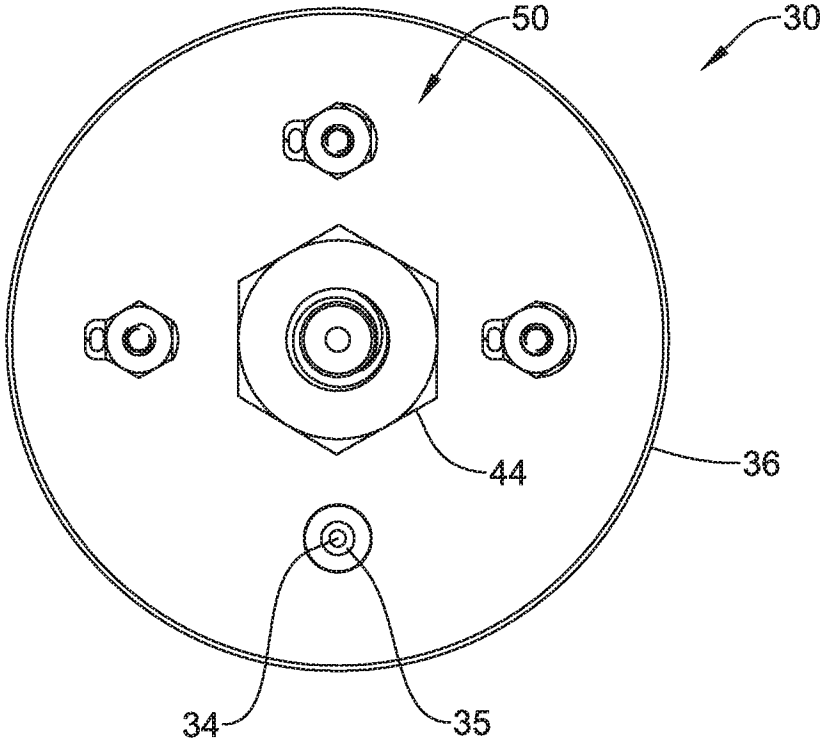
FIG. 5 is a second end view of the illustrative anode layer ion source in FIG. 2.

FIG. 5 is an end view of the anode layer ion source 30 depicting a closed end 50 of the housing 36 with the standoff 44, the keep-alive electrode 34, and the insulator 35 extending therefrom. Although the standoff 44, the keep-alive electrode 34, and the insulator 35 are depicted as extending from the closed end 50 of the housing 36, this is not required. For example, the standoff 44 may be omitted and/or one or both of the keep-alive electrode 34 and the insulator 35 may not extend all the way through the housing 36 and thus, may not extend to an exterior of the housing 36 through the closed end 50.

Figure 6:
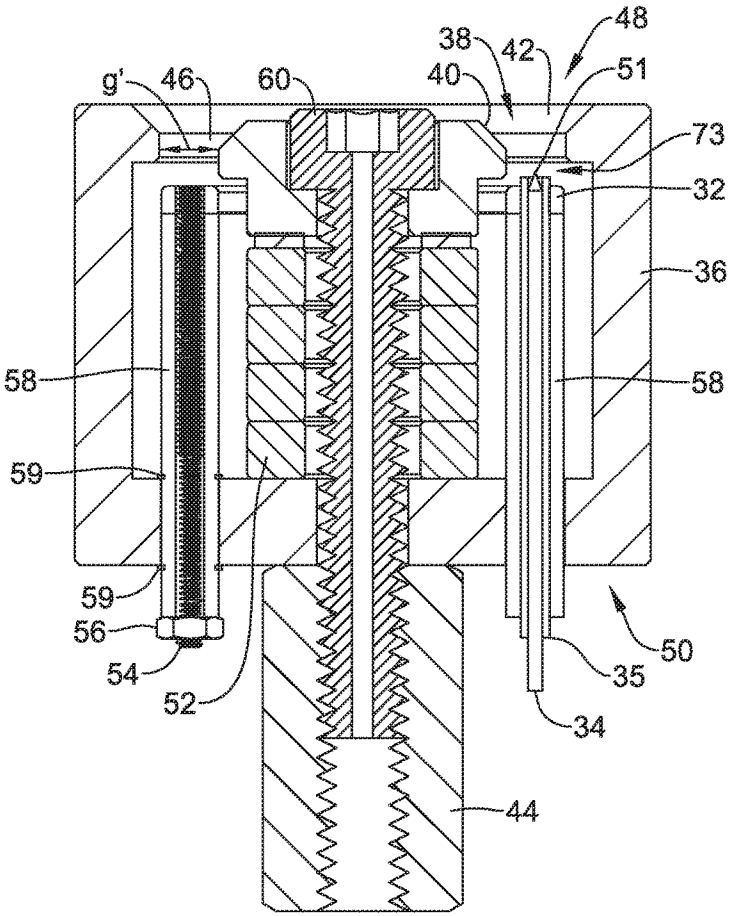
FIG. 6 is a cross-sectional view of the illustrative anode layer ion source in FIG. 2, taken along line 6-6 in FIG. 3.

FIG. 6 is a cross-section of the anode layer ion source 30, taken along line 6-6 in FIG. 3. In some cases, the keep-alive electrode 34 may extend through the insulator 35 to the anode 32. Although the keep-alive electrode 34 and the insulator 35 are depicted as extending through the anode 32, the keep-alive electrode 34 and/or the insulator may be configured in one or more other manners. For example, the keep-alive electrode 34 may be positioned in a suitable manner such that it has a tip 51 configured to produce a field emission in a gap 73 between the anode 32 and the gap 46 (e.g., between the first pole 40 and the second pole 42). In some cases, the keep-alive electrode 34 may have a tapered portion terminating at the tip 51 (e.g., a point). The finer the tip 51 of the keep-alive electrode 34, the more efficient the electrical field emission may be from the keep-alive electrode 34.

The anode 32 and the keep-alive electrode 34 may be made from a suitable type of electrically conductive material. In some cases, one or both of the anode 32 and the keep-alive electrode 34 may be made from tungsten, molybdenum, and/or other material (e.g., other electrically conductive metal and/or polymer).

In some cases, the anode 32 may be positioned at a particular distance from the first pole 40 and/or the second pole 42 using one or more sets of spacing components (e.g., the configuration of FIGS. 2-6 utilizes four sets of spacing components). The sets of spacing components may include, but are not limited to, a threaded connector 54 or other connector, a nut 56, a spacer 58, a retainer clip 59, and/or one or more other spacing components. In some cases, the spacing components may support the anode 32 at a location within the housing (e.g., at a locations spaced from the closed end 50 and/or the opened end 48 of the housing 36). The spacer 58 may be made from an alumina insulator (e.g., a ceramic insulator) and/or other insulator material.

To facilitate creating a magnetic field (see FIGS. 12-15) between the first pole 40 and the second pole 42, the anode layer ion source 30 may include a magnet 52. In some cases, the magnet 52 may be centrally located within the housing 36, but this is not required.

The magnet 52 may be a suitable type of magnet powerful enough to create a magnetic field across the gap 46 between the first pole 40 and the second pole 42 and discharge an ion beam in response to interacting with an electric field from the anode 32. The magnet 52 may be a high temperature magnet that is compatible with hydrogen, deuterium, and/or one or more other gases. Alternatively or in addition, the magnet 52 may have one or more additional or alternative properties. In one example anode layer ion source 30, the magnet 52 may be made from and/or may include samarium cobalt (SmCo).

As depicted in FIG. 6, the first pole 40 and the magnet 52 may be held in place within the housing 36 with a connector 60. In some cases, the connector 60 may be configured to extend through the first pole 40, the magnet 52, and/or the closed end 50 of the housing 36 and connect to the standoff 44, a nut, the housing 36, and/or other engaging feature. As depicted in FIG. 6, threads of the connector 60 may engage threads of the standoff 44 and secure the first pole 40 and the magnet 52 in place within the housing 36 and between a head of the connector 60 and the closed end 50 of the housing 36. The first pole 40 and the magnet 52 may be positioned within the housing 36 in one or more other manners, as desired.

Figure 7:
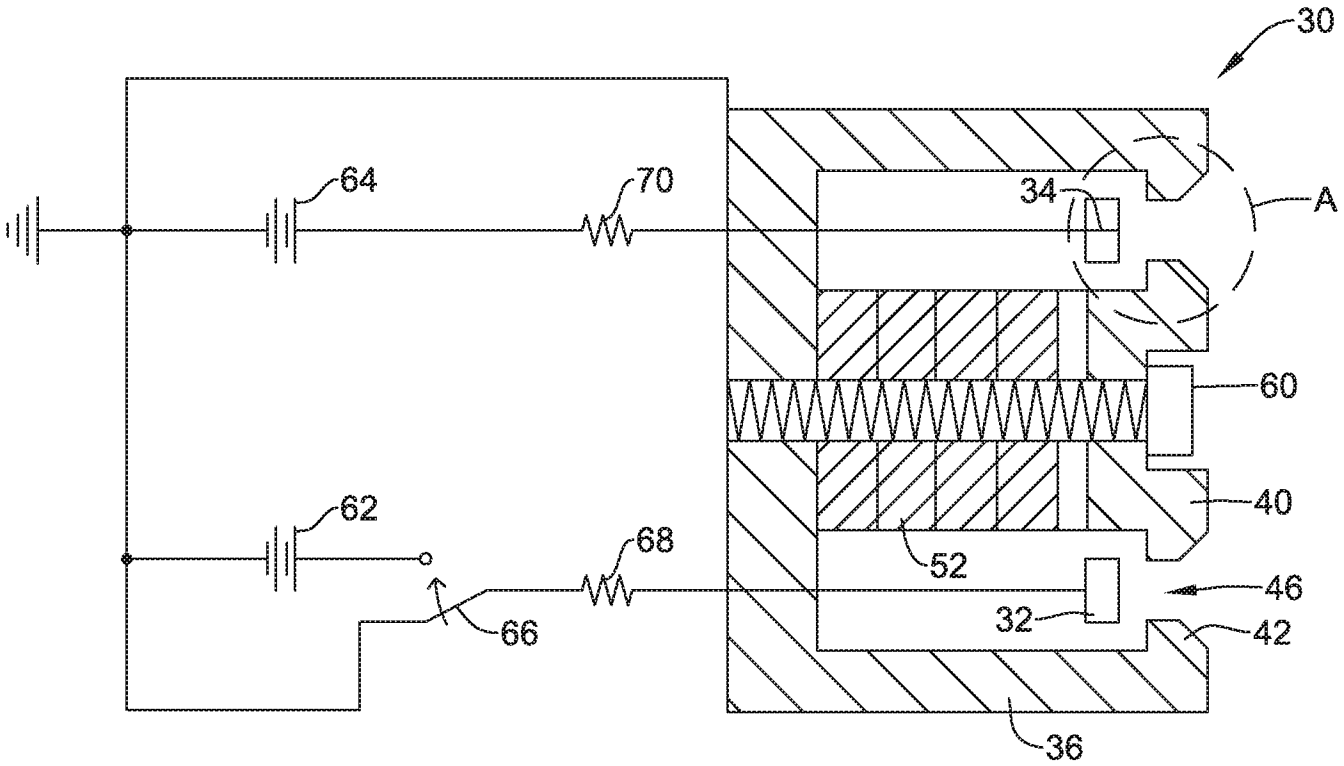
FIG. 7 is a schematic diagram of an illustrative ion source and associated power circuit.

FIG. 7 depicts a schematic cross-sectional view of the anode layer ion source 30, along with a schematic example circuit for the anode layer ion source 30. As shown in FIG. 7, the anode 32 may be connected to a first power source 62 and the keep-alive electrode 34 may be connected to a second power source 64, however, this is not required and both of the keep-alive electrode 34 and the anode 32 may be connected to the same power source. In one example, the anode 32 may be connected to a positive terminal of the first power source 62 and the keep-alive electrode 34 may be connected to a positive terminal of the second power source 64, where negative terminals of the first power source 62 and the second power source 64 may be connected to ground. However, in some cases, the keep-alive electrode 34 may be connected to the negative terminal of the second power source 64. Further, the housing 36 may be connected to ground.

One or more electronic components may be located between the anode 32 and the first power source 62. For example, as shown in FIG. 7, a switch 66 and a first resistor 68 may be provided between the first power source 62 and the anode 32, among other components.

The first power source 62 may be a suitable type of power source configured to provide a desired amount of voltage to the anode 32. In some cases, the first power source 62 may be configured to provide a first voltage. The first voltage may be a suitable voltage, for example, a voltage between about five hundred (500) volts and about four (4) kilovolts (kV) or other suitable voltage. In one example, the first voltage may be on the order of about 2 kV of direct current (DC) or other amount of voltage.

The switch 66 may be configured to selectively provide power to the anode 32. For example, when the switch 66 is in an opened position, the circuit may be configured such that no power is provided from the first power source 62 to the anode 32. When the switch 66 is in a closed position, the circuit may be configured such that power is provided from the first power source 62 to the anode 32.

In the circuit example of FIG. 7, the switch may 66 be a single pole dual throw switch, which may allow the anode 32 to be connected to ground when the switch 66 is in the opened position. Connecting the anode 32 to ground when the switch is open (e.g., when the anode 32 is not receiving power from the first power source 62) may provide a return path for any current from the keep-alive electrode 34 that returns through the anode 32. In addition or alternatively, current from the keep-alive electrode 34 may return through one or more of the first pole 40 and the second pole 42. Other suitable switch types and/or configurations are contemplated.

The switch 66 may be a high-speed switch, but this is not required. A high-speed switch may facilitate generating high-speed pulses of current. In some cases, the switch may be a non-high-speed switch when high-speed pulses of current may not be required and/or needed.

The first resistor 68 may be a suitable type of resistor providing a desired amount of resistance between the first power source 62 and the anode 32. In some cases, the first resistor 68 may be configured to have a first amount of resistance. The first amount of resistance may be a suitable amount of resistance, for example, an amount of resistance between about two hundred (200) ohms (Ω) and about two (2) kiloohms (kΩ) or other amount of resistance. In one example, the first resistance may be about 1 kΩ or other amount of resistance.

In one example configuration of the circuit, the first power source 62 may be configured to provide about 2 kV DC to the anode 32 and the first resistor 68 may be configured to provide a resistance of 1 kΩ. As a result, when the switch 66 is in a closed position and without taking into account a resistance of any plasma present adjacent the anode 32, the first resistor 68 may limit the current that the first power source 62 provides to the anode 32 to a current of less than about two (2) amperes (A). However, in operation and depending on a pressure of the gas around the anode 32, the first power source 62 may provide a charge to the anode 32 at a current on the order of about 500 mA.

One or more electronic components may be located between the keep-alive electrode 34 and the second power source 64. For example, as shown in FIG. 7, a second resistor 70 may be provided between the second power source 64 and the keep-alive electrode 34, among other components. In some cases, a switch may not be provided between the second power source 64 and the keep-alive electrode 34 and as a result, power from the second power source 64 to the keep-alive electrode 34 may not be controllable between of the second power source 64 and the keep-alive electrode 34. Alternatively, a switch may be provided between the second power source 64 and the keep-alive electrode 34 to facilitate controlling power between the second power source 64 and the keep-alive electrode 34 and/or for other purposes. In some cases, power may be continuously provided to the keep-alive electrode 34 while the second power source 64 has a charge.

The second power source 64 may be a suitable type of power source configured to provide a desired amount of voltage. In some cases, the second power source 64 may be configured to provide a second voltage. The second voltage may be a suitable voltage, for example, a voltage between one (1) kV and about ten (10) kV. In one example, the second voltage may be on the order of about 6 kV of DC or other amount of voltage.

The second resistor 70 may be a suitable type of resistor providing a desired amount of resistance between the second power source 64 and the keep-alive electrode 34. In some cases, the second resistor 70 may be configured to have a second amount of resistance, which may be greater than the first amount of resistance of the first resistor 68.

A resistance for the circuit providing power to the keep-alive electrode 34 may be utilized to limit the current to the keep-alive electrode 34 for the purpose of controlling the seed plasma or field emission discharge current, preventing or mitigating a likelihood of a plasma arc between the keep-alive electrode 34 and the anode 32, and/or for one or more other purposes. In some cases, the second amount of resistance a suitable amount of resistance configured to limit the keep alive electrode current less than a few mA and in some examples less than one (1) mA. For example, a suitable amount of resistance may be between about one (1) megaohms (MΩ) and about 100 MΩ or other suitable amount of resistance. In one example, the second amount of resistance may be on the order of about ten (10) MΩ or other suitable amount of resistance.

In one example configuration of the circuit, the second power source 64 may be configured to provide about 6 kV DC to the keep-alive electrode 34 and the second resistor 70 may be configured to provide a resistance of about 10 MΩ. As a result, the second power source 64 may provide a charge to the keep-alive electrode 34 at a current on the order of less than about one mA (e.g., in some cases on the order of about six hundred (600) microamperes (μA)).

Figure 8:
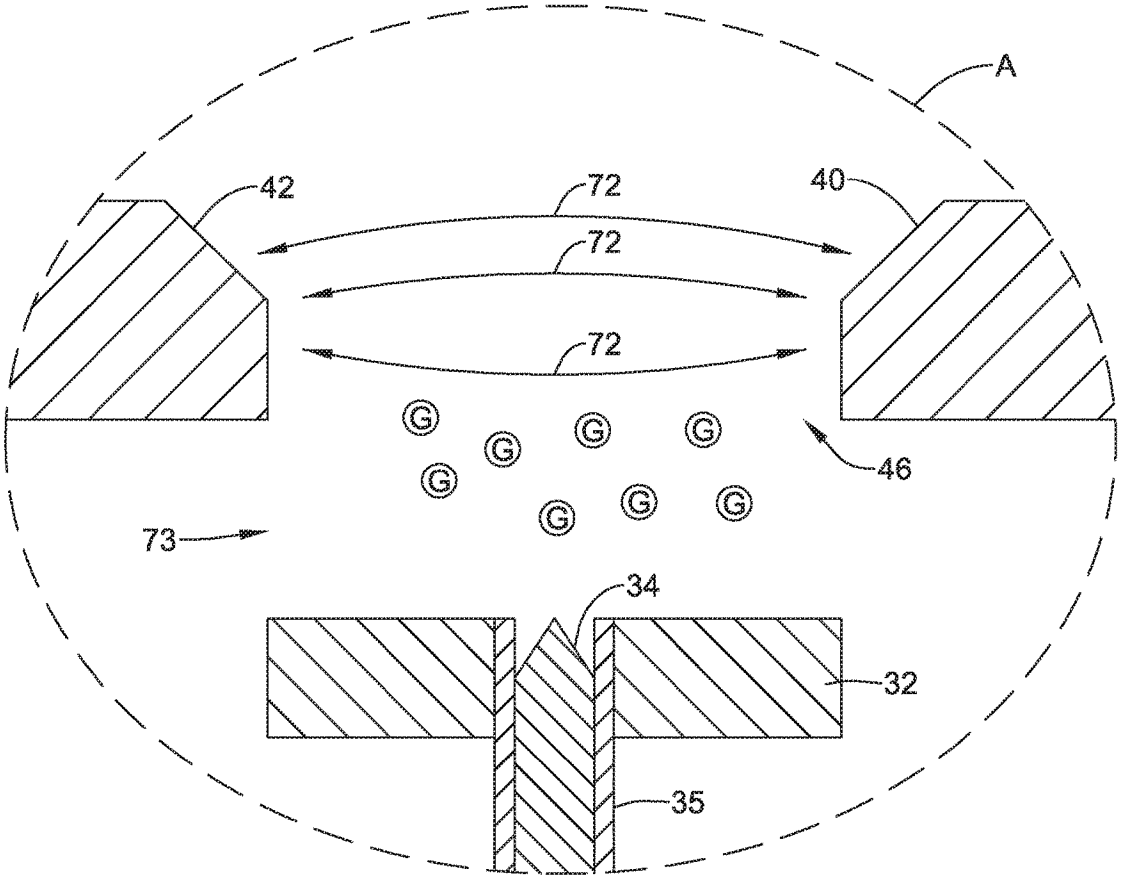
FIGS. 8-10 depict steps in a method of using the illustrative ion source and associated power circuit of FIG. 7 with a schematic magnified view of features within circle A in FIG. 7.
Figure 9:
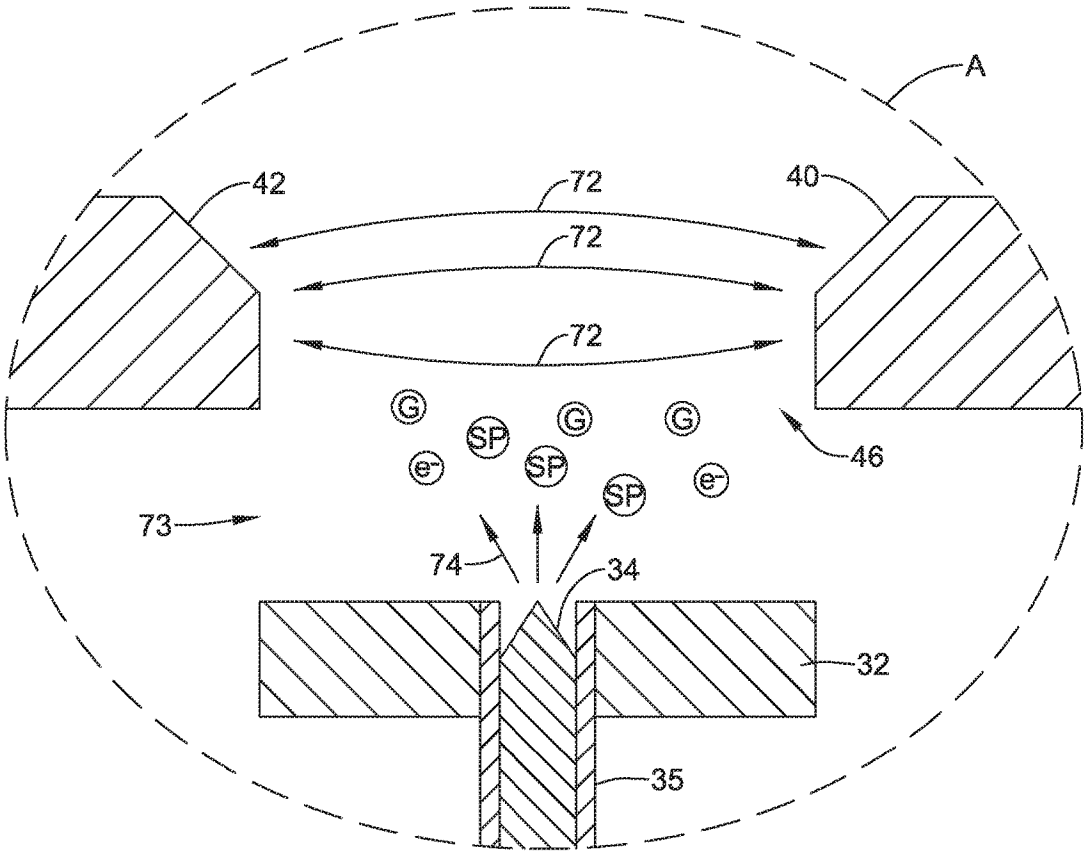
Figure 10:
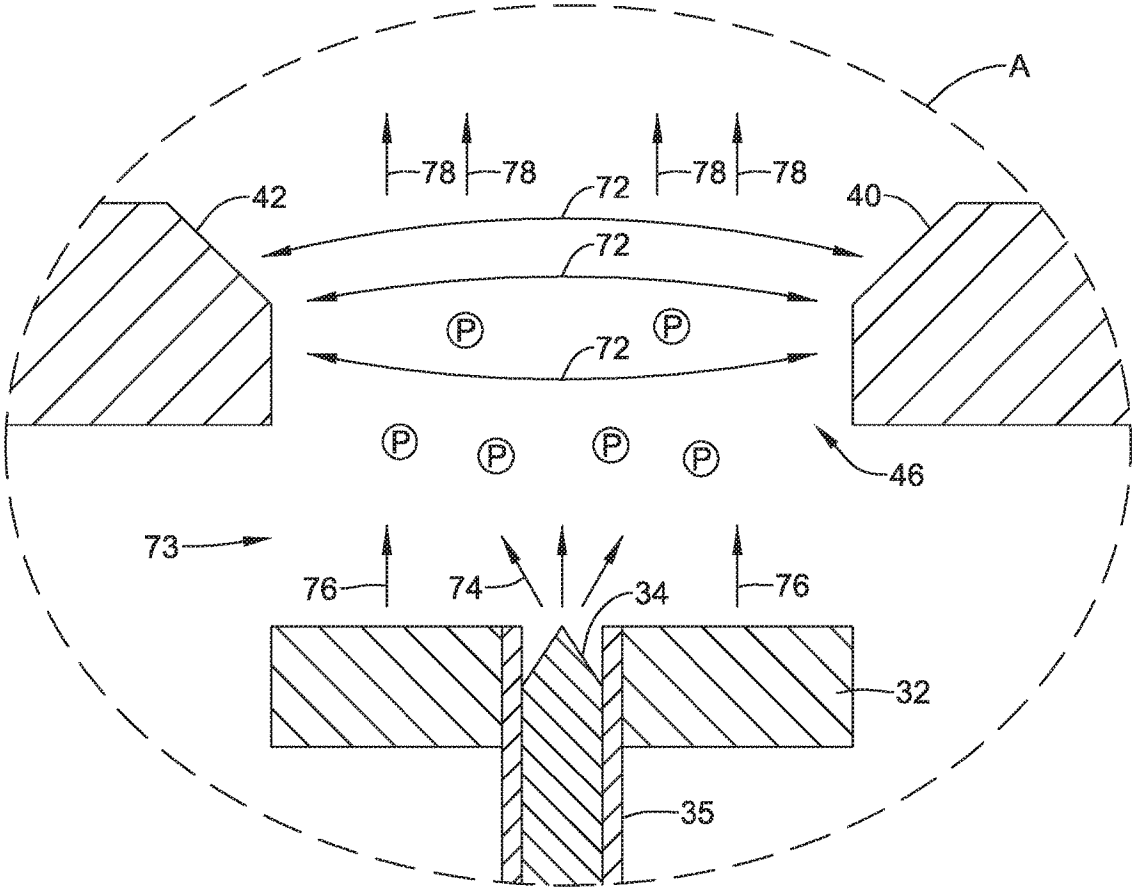

FIGS. 8-10 depict a schematic operation of the anode layer ion source 30 with a magnified view of circle A in FIG. 7. FIG. 8 depicts the first pole 40, the second pole 42, and a magnetic field, represented by arrows 72, extending across the gap 46 between the first pole 40 and the second pole 42. In the gap 73 between the gap 46 and the anode 32, neutral gas atoms, G, may be provided. In FIG. 9, a current may be applied to the keep-alive electrode to produce an electric field, as represented by arrows 74. Electrons, $e^-$, in the electric field provided from the keep-alive electrode 34 may interact with the neutral gas atoms, G, around the anode 32 to create a seed plasma (e.g., positively charged ions and electrons), SP, that may disperse around the anode 32. The current applied to the keep-alive electrode 34 may be limited by a resistor (e.g., the second resistor 70) to prevent plasma arcing between the keep-alive electrode 34 and the anode 32.

Once the seed plasma, SP, and/or electrons, $e^-$, have been produced, a voltage may be applied to the anode 32 to create an electric field in the gap 73, as represented by arrows 76 in FIG. 10. The electric field produced from anode 32 (e.g., the electric discharge) may interact with the seed plasma, SP, and/or electrons, $e^-$, and the remaining neutral gas atoms, G, to create plasma, P. Then, the electric field produced by the anode 32 may propel or accelerate the plasma, P, to form an ion beam, as represented by arrows 78. Because the plasma, P, and seed plasma, SP, may be created by knocking electrons loose from neutral gas atoms with the produced electric fields and because the more electrons that are present the faster plasma may be produced from the neutral gas atoms (assuming there is a sufficient amount of neutral gas atoms), the anode layer ion source 30 is able to quickly form plasma, P, and an ion beam when the electric field is provided by the anode 32 due to electrons being present in the seed plasma.

Figure 11:
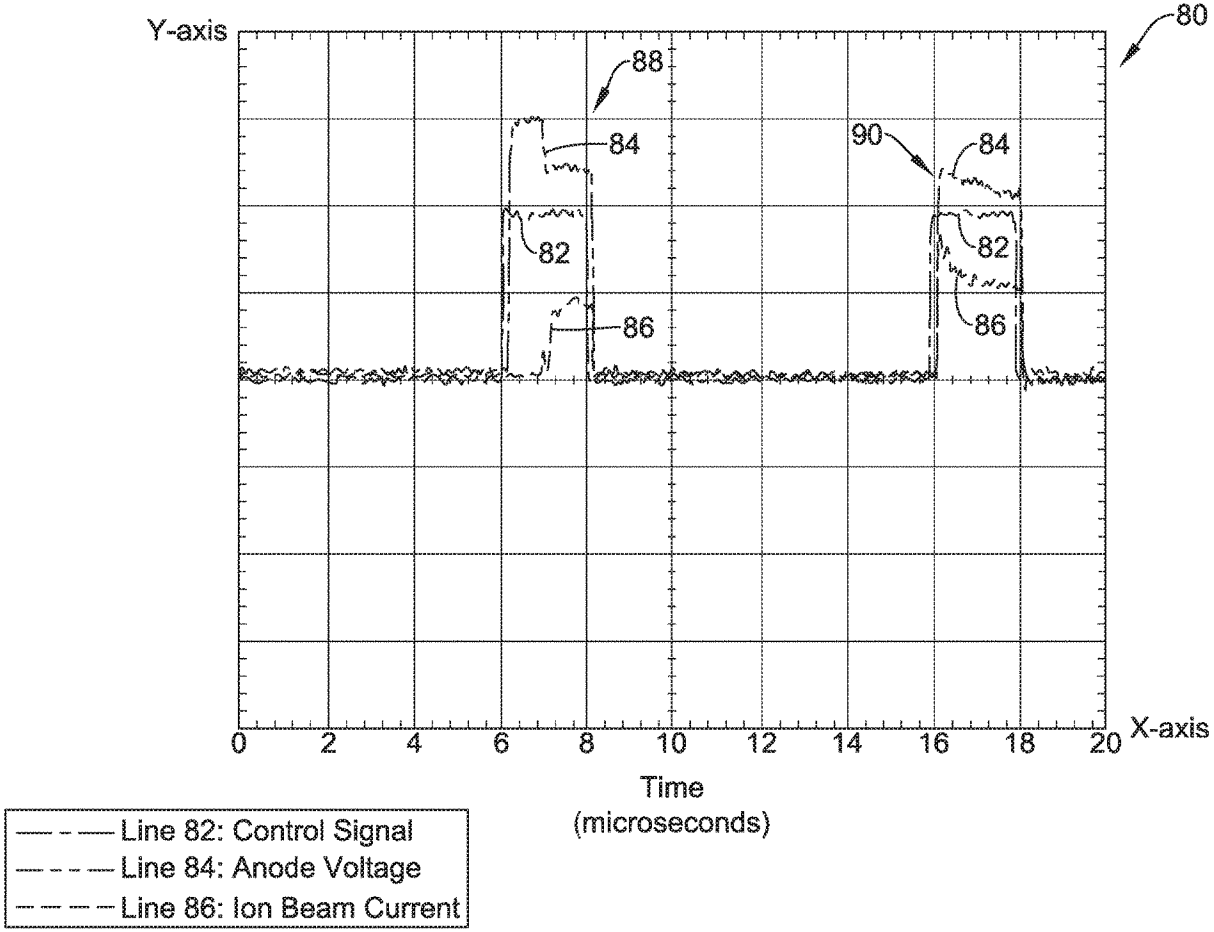
FIG. 11 is a graph depicting ion beam current in response to a voltage applied to an ion source having a keep-alive electrode.

FIG. 11 is a graph 80 showing performance measurements for an ion source, such as the anode layer ion source 30 having the keep-alive electrode 34 and the circuit configuration depicted in FIG. 7. In the graph 80, line 82 represents a control signal to the switch 66, line 84 represents voltage provided to the anode 32, and line 86 represents a current of an ion beam (e.g., the electrical discharge from the anode layer ion source 30).

In operation, when applying an initial ion pulse 88 to the anode layer ion source 30, a control signal (e.g., as represented by the line 82 in the graph 80) may be applied to the switch 66 and in response, the switch 66 may move to a closed position causing a voltage to be applied to the anode 32 (e.g., as represented by the line 84 in the graph 80). The voltage may be applied (e.g., rapidly applied) to the anode 32 and after a period of time, t, an ion beam may be initiated (e.g., as represented by the line 86 in the graph 80). During the period of time, t, electrons in the electric field created by the voltage applied to the anode 32 may interact with neutral gas atoms to produce a mixture of positively charged gas ions and free electrons (e.g., a plasma). The electric field caused by the voltage applied to the anode 32 may create an ion beam by accelerating or propelling the positively charged gas ions that form the ion beam.

As discussed above, typical ion sources (e.g., anode layer ion sources or other ion sources) without a keep-alive electrode may have a time period, t, between application of a voltage to an anode or other electrode and when an ion beam is formed (e.g., turn on delay) of about two (2) milliseconds (ms) during which time the electric field from the anode or other electrode interacts with neutral gas atoms around the anode or other electrode to create a plasma and eventually the ion beam. However, in an ion source (e.g., the anode layer ion source 30 or other ion source) with a keep-alive electrode (e.g., the keep-alive electrode 34 or other keep-alive electrode) that may provide a seed plasma and/or electron presence between the anode 30 and a gap between magnetic poles, may produce the ion beam after a delay of about one (1) microsecond or less with low turn on jitter. As a result, when a keep-alive electrode is present to provide a seed plasma and/or electron presence adjacent the anode, it is possible to achieve a shorter turn on delay than is otherwise achievable without the keep-alive electrode providing a seed plasma and/or electron presence.

Further, when providing a subsequent ion pulse 90 at a time period after the initial pulse, as shown in FIG. 11, it may be possible to achieve even shorter turn on delays. At the subsequent pulse 90, a control signal may be applied to the switch 66 (e.g., as represented by an initial rise in the line 82 of the graph 80) and in response, the switch 66 may move to a closed position causing a voltage to be applied to the anode 32 (e.g., as represented by an initial rise in line 84 in graph 80). The voltage may be rapidly applied to the anode 32 and the ion beam may be re-initiated concurrently with or subsequent to the application of voltage to the anode. Such short turn on delays may be possible as drifting electrons may remain present above the anode due, at least in part, to a short time period between initiations of ion pulses that may be achieved when using a keep-alive electrode to provide seed plasma and/or an electron presence.

Because of the short turn on delay and low jitter for producing an ion beam from ion sources having a keep-alive electrode to provide a seed plasma and/or electron presence as discussed herein, fast ion pulse generation may be possible due, at least in part, to electrons drifting above an anode of the ion sources. For example, the subsequent ion pulse 90 after the initial ion pulse 88 may be achieved within ten (10) microseconds or more from when the initial ion pulse was initiated as long as there are electrons drifting above the anode. Further, with the fast ion pulse generation, a high ion beam current may be achieved. In one example, an ion beam from an ion source having a keep-alive electrode to provide a seed plasma and/or electron presence adjacent to the anode may have a current in the 100s of mA or greater.

FIGS. 12-15 depict illustrative configurations of the keep-alive electrode 34 with respect to the anode 32 in a magnified view of circle A in FIG. 7. Although FIGS. 12-15 depict the keep-alive electrode 34 extending through an opening in the anode 32, the keep-alive electrode 34 may be positioned at a suitable location relative to the anode 32 such that the keep-alive electrode 34 is configured to create an electric field in gap 73.

As discussed above, power may be provided to the keep-alive electrode 32 at a level of current that may be configured to prevent or mitigate a likelihood of arcing between the keep-alive electrode 34 and the anode 32. In some cases, the configurations of the keep-alive electrode 34 in FIGS. 12-15 may further prevent or mitigate the likelihood of arcing between the keep-alive electrode 34 and the anode 32.

Figure 12:
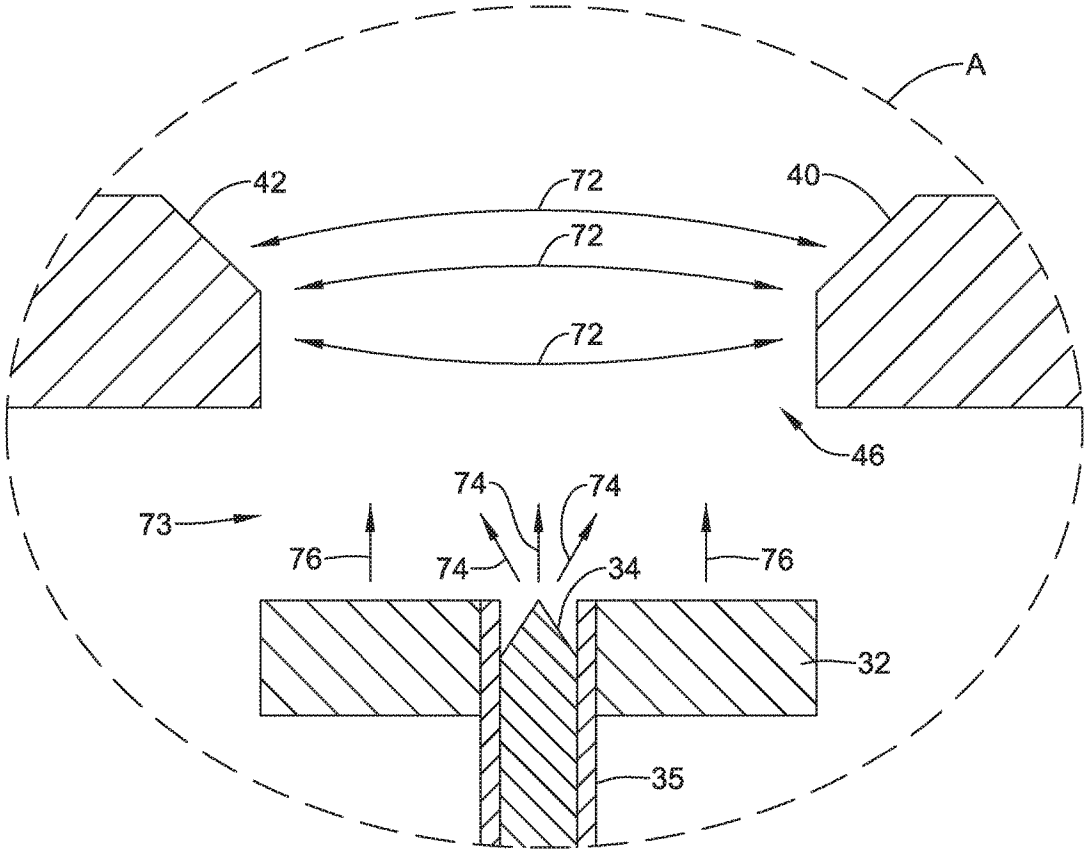
FIG. 12 is a schematic magnified view of features in circle A of FIG. 7 for a configuration of the illustrative ion source in FIG. 7.

FIG. 12 depicts the keep-alive electrode 34 within the insulator 35 and extending through an opening of the anode 32, as shown in FIG. 9. In some cases, the insulator 35 may prevent the electric field from the keep-alive electrode 34 from creating a plasma or electric arc with the anode 30. In addition or as an alternative, a gap (not shown) may be provided between the keep-alive electrode 34 and the anode 32 to prevent an electrical short between the keep-alive electrode 34 and the anode 32 by preventing direct contact therebetween.

Figure 13:
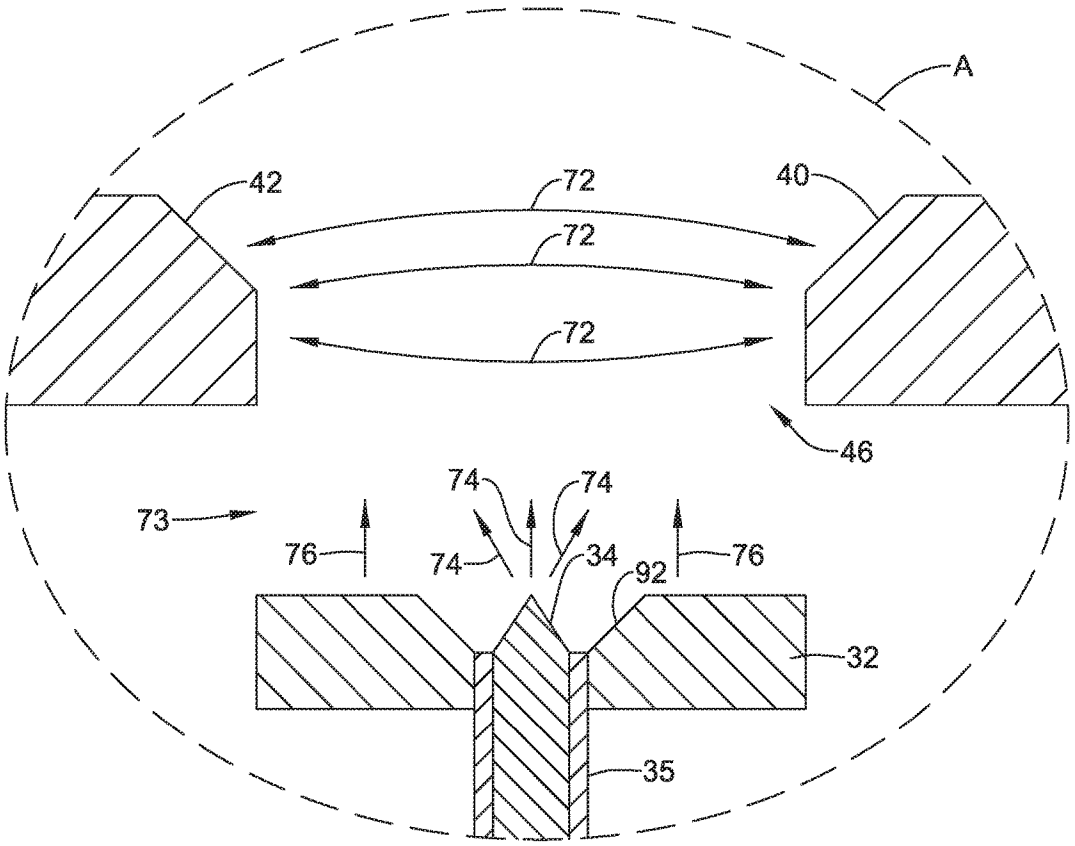
FIG. 13 is a schematic magnified view of features in circle A of FIG. 7 for another configuration of the illustrative ion source in FIG. 7.

FIG. 13 depicts a further configuration of the keep-alive electrode 34 extending through an opening in the anode 32. The anode 32 may have a chamfered edge 92 adjacent to or abutting insulator 35 around the keep-alive electrode 34. In some cases, the chamfered edge 92 may extend from a first side of the anode 32 to a location of the electrode at or below a tapered portion of the electrode. Because of the chamfered edge 92 of the anode 32, a sufficient distance between a location where an electric field is concentrated on the keep-alive electrode 34 (e.g., the tapered and tip portion of the keep-alive electrode 34) and the anode 32 may be created such that arcing between the anode 32 and the keep-alive electrode 34 may be unlikely. Although an insulator 35 is shown in FIG. 13 as contacting the anode 32, a gap may be provided around the keep-alive electrode 34 (e.g., when the insulator 35 is omitted or otherwise) and/or the insulator 35 to prevent an electrical short between the keep-alive electrode 34 and the anode 32 by preventing direct contact therebetween.

Figure 14:
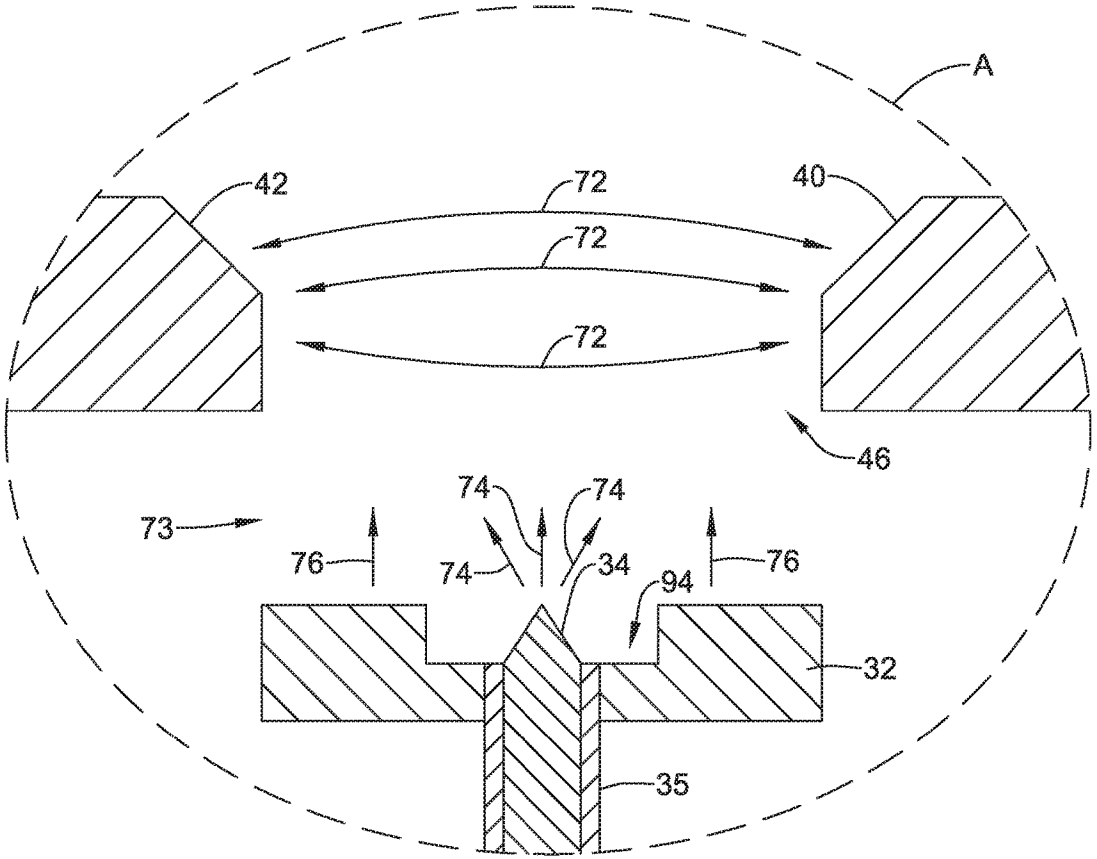
FIG. 14 is a schematic magnified view of features in circle A of FIG. 7 for another configuration of the illustrative ion source in FIG. 7.

FIG. 14 depicts a further configuration of the keep-alive electrode 34 extending through an opening in the anode 32. The anode 32 may have a stepped edge 94 adjacent to or abutting the insulator 35 around the keep-alive electrode 34. In some cases, the stepped edge 94 may extend from a first side of the anode 32 to a location of the electrode at or below the tapered portion of the electrode. Because of the stepped edge 94 of the anode 32, a sufficient distance between a location where an electric field is concentrated on the keep-alive electrode 34 (e.g., the tapered and tip portion of the keep-alive electrode 34) and the anode 32 may be created such that arcing between the anode 32 and the keep-alive electrode 34 may be unlikely. Although an insulator 35 is shown in FIG. 14 as contacting the anode 32, a gap may be provided around the keep-alive electrode 34 (e.g., when the insulator 35 is omitted or otherwise) and/or the insulator 35 to prevent an electrical short between the keep-alive electrode 34 and the anode 32 by preventing direct contact therebetween.

Figure 15:
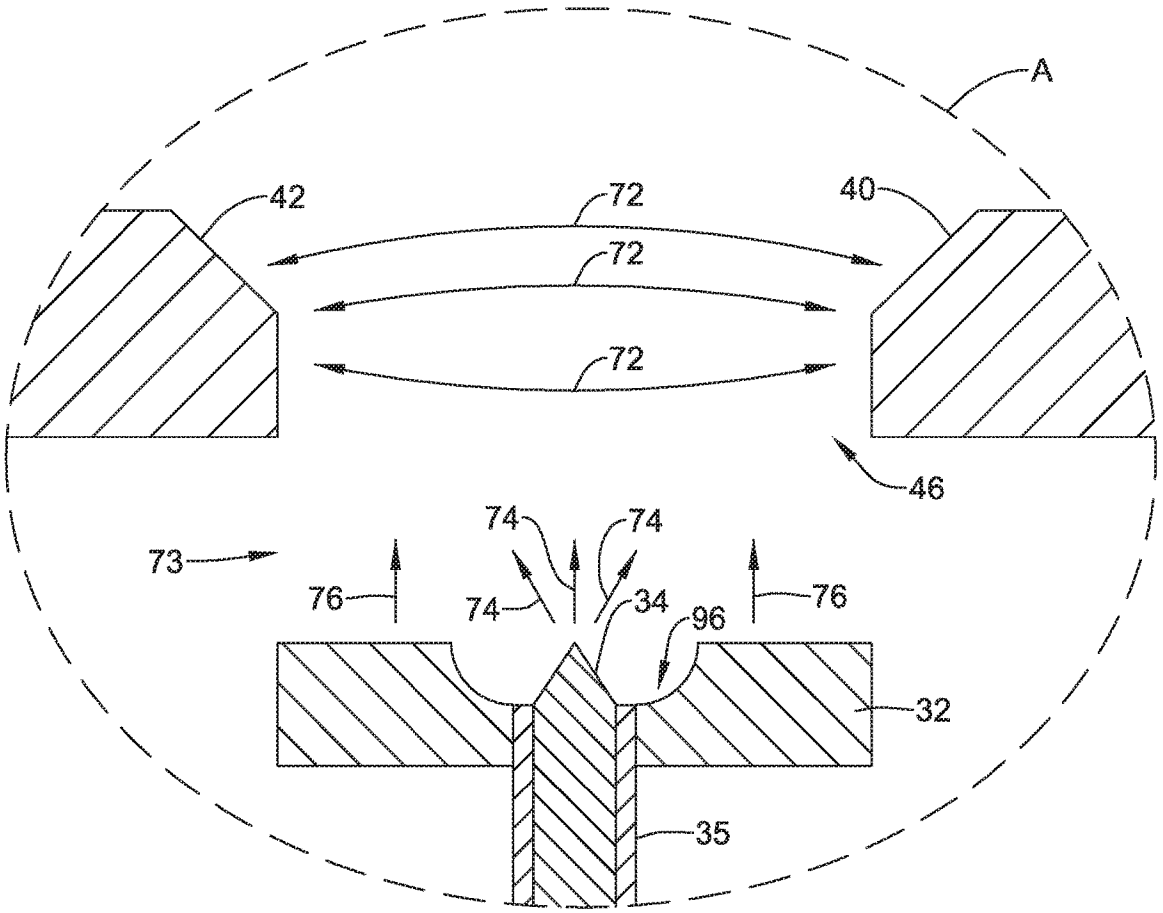
FIG. 15 is a schematic magnified view of features in circle A of FIG. 7 for another configuration of the illustrative ion source in FIG. 7.

FIG. 15 depicts a further configuration of the keep-alive electrode 34 extending through an opening in the anode 32. The anode 32 may have a curved or rounded edge 96 adjacent to or abutting the insulator 35 around the keep-alive electrode 34. In some cases, the curved or rounded edge 96 may extend from a first side of the anode 32 to a location of the electrode at or below the tapered portion of the electrode. Because of the curved or rounded edge 96 of the anode 32, a sufficient distance between a location where an electric field is concentrated on the keep-alive electrode 34 (e.g., the tapered and tip portion of the keep-alive electrode 34) and the anode 32 may be created such that arcing between the anode 32 and the keep-alive electrode 34 may be unlikely. Although an insulator 35 is shown in FIG. 15 as contacting the anode 32, a gap may be provided around the keep-alive electrode 34 (e.g., when the insulator 35 is omitted or otherwise) and/or the insulator 35 to prevent an electrical short between the keep-alive electrode 34 and the anode 32 by preventing direct contact therebetween.

Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. An ion source device for producing an ion beam, comprising:

a housing having an opening;

a first electrode within the housing and having a first side facing the opening, the first electrode is configured to provide a first electric field toward the opening; and a second electrode having an end within the housing, the second electrode is configured to maintain one, or both of, a presence of electrons or a seed plasma between the first electrode and the opening when the first electric field is absent.

2. The device of claim 1, further comprising:

a power source providing power to the first electrode;

a switch located between the power source and the first electrode, the switch having an opened position in which a power is prevented from flowing between the power source and the first electrode and a closed position in which power flows from the power source to the first electrode;

wherein the second electrode is configured to maintain one, or both of a presence of electrons or a seed plasma between the first electrode and the opening when the switch is in the opened position.

3. The device of claim 1, further comprising:

a power source;

wherein:

the first electrode is connected to the power source and is configured to receive power at a first level of current; and the second electrode is connected to the power source and is configured to receive power at a second level of current that is less than the first level of current.

4. The device of claim 1, further comprising:

a first power source providing power to the first electrode at a first current level;

a second power source providing power to the second electrode at a second current level that is less than the first current level.

5. The device of 4, further comprising:

a first resistor located between the first power source and the first electrode;

a second resistor located between the second power source and the second electrode, the second resistor having a greater resistance than the first resistor.

6. The device of claim 1, wherein the second electrode is configured to receive power at a level of current that maintains one, or both of, a presence of electrons or a seed plasma between the first side of the first electrode and the opening and prevents a plasma arc between the second electrode and the first electrode.

7. The device of claim 1, wherein the end of the second electrode in the housing is tapered and terminates at a point.

8. The device of claim 1, wherein an insulating material surrounds the second electrode.

9. The device of claim 1, wherein the second electrode extends through the first electrode.

10. The device of claim 1, wherein:

the first electrode is an anode having an anode opening extending from the first side of the anode;

the second electrode extends through the anode opening.

11. The device of claim 10, wherein the anode opening has a chamfered edge extending from the first side of the anode.

12. The device of claim 10, wherein anode opening has a stepped edge extending from the first side of the anode.

13. The device of claim 1, further comprising:

a first magnetic pole extending within the housing; and wherein:

the housing forms a second magnetic pole; and the first magnetic pole and the second magnetic pole create a magnetic field across the opening.

14. An ion source comprising:

a first magnetic pole;

a second magnetic pole at least partially defining an opening with the first magnetic pole;

a first electric field generator configured to provide a first electric field toward the opening; and a second electric field generator configured to provide a second electric field between the first electric field generator and the opening.

15. The ion source of claim 14, wherein:

the first electric field generator is configured to selectively provide the first electric field; and the second electric field generator is configured to provide the second electric field before the first electric field is provided.

16. The ion source of claim 14, wherein the second electric field generator is configured to provide one, or both of, electrons or seed plasma between the first electric field generator and the opening.

17. The ion source of claim 14, further comprising:

a switch configured to close a circuit between a power source and the first electric field generator when in a closed position and open the circuit when in an opened position;

a current limiter configured to limit current to the second electric field generator.

18. A method of providing an ion beam, the method comprising:

Providing one, or both of, electrons or seed plasma between an anode and an opening in a housing to provide a presence of one, or both of, electrons or seed plasma adjacent the anode;

applying a power to the anode to generate an electric field while the presence of one, or both of, electrons or seed plasma adjacent the anode is provided; and discharging an electric discharge through the opening in the housing to produce an ion beam.

19. The method of claim 18, further comprising:

adjusting a switch to a closed position to provide power to the anode;

adjusting the switch to an opened position to prevent power from reaching the anode; and maintaining the provided presence of electrons or seed plasma adjacent the anode when the switch is in the opened position.

20. The method of claim 19, further comprising:

limiting a current level of power provided to an electrode used in providing the one, or both of, electrons or seed plasma to prevent arcing between the electrode and the anode.

* * * * *